US005617797A

United States Patent [19]

Casey

[11] Patent Number: 5,617,797

[45] Date of Patent: Apr. 8, 1997

[54] STUD SHELVING

[76] Inventor: Alan F. Casey, 548 Princeway Ct., Manchester, Mo. 63011

[21] Appl. No.: 630,968

[22] Filed: Apr. 8, 1996

[51] Int. Cl.[6] ..... A47B 23/00

[52] U.S. Cl. ..... 108/42; 211/135

[58] Field of Search ..... 108/42, 143, 193, 108/192, 100; 52/36.4, 36.6; 211/135, 153

[56] References Cited

U.S. PATENT DOCUMENTS

| | | | |
|---|---|---|---|
| 747,363 | 12/1903 | Bennett | 108/42 |
| 1,270,718 | 6/1918 | Ford | 211/135 X |
| 2,260,915 | 10/1941 | Mummery | 108/42 |
| 2,441,721 | 5/1948 | Schroeder | 211/135 X |
| 2,465,635 | 3/1949 | Conterio | 211/135 X |
| 2,849,123 | 8/1958 | Magill | 108/42 |
| 3,698,329 | 10/1972 | Diamond et al. | 211/135 X |
| 4,074,635 | 2/1978 | Stauble | 211/135 X |
| 5,022,721 | 6/1991 | Melgers | 108/180 X |

*Primary Examiner*—Jose V. Chen
*Attorney, Agent, or Firm*—Norman L. Wilson, Jr.

[57] ABSTRACT

Shelving patent emphasis appears to be concentrated on ventilated shelving. The shelving herein is for use with wall studs. The areas between studs in garages, basements, and attics usually constitute wasted space. This space is even less pleasing when free standing shelves are placed in front of studs. There is a need for shelves which effectively utilize the spaces between exposed studs. Stud shelves available commercially are only as deep as the depth of the studs themselves, and both hands are needed to screw or nail up one end of the shelf while the other end of the shelf dangles freely. The shelving herein extends beyond the front edges of the studs, and spikes support the shelves during installation.

7 Claims, 2 Drawing Sheets

STUD SHELVING

FIELD OF THE INVENTION

This invention, in one of its aspects, relates to shelving. In a more specific aspect the invention pertains to stud shelves.

BACKGROUND OF THE INVENTION

Shelving has long been included in the patent art. In fact, a computer generated listing of shelf patents contained more numbers than could practically be examined. No shelving, however, could be located in combination with wall studs. Patent emphasis appears now to be concentrated on ventilated shelving. This is so even though the areas between studs in garages, basements, attics and the like have always constituted wasted space, used to store cans, odd shaped boxes, tools, and other miscellaneous items detracting from the area's appearance. The spaces between studs is even less pleasing when free standing shelves are placed in front of studs. The exposed areas between studs behind the shelves are unharmonious spaces into which items frequently fall, making the free standing shelves in front of them even less desirable.

Clearly there is an obvious need for shelves which effectively utilize the spaces between studs where they are exposed. The only stud shelves we are aware of in the patent art are window units such as that described in U.S. Pat. No. 5,400,557. Plastic stud shelves are available commercially as revealed in some mailing pieces, but they are subject to improvement. They do not extend forwardly beyond the fronts of the studs. Since the shelves are only as deep as the depth of the studs themselves they are not as practical as they could be because they are not deep enough. More disturbing is the fact that both hands are needed to screw or nail up one end of the shelf. The installation becomes frustrating when the other shelf end attempts to hang downwardly or dangles freely. The installation of stud shelves is almost two person task. This is especially true if continuous shelving is desired. To form continuous shelving, tabs by which shelves are attached to the studs overlap. In other words the hole in one tab must be placed over a hole in an adjacent tab so that a single screw supports two shelf ends. The result is that the installer must in some way attempt to support both shelves while at the same time using both hands to insert a screw or nail in the two overlapping holes.

The invention herein overcomes both of the disadvantages discussed. The shelving provided extends beyond the front edges of the stud. The shelf depth, then, is not dependent upon stud depth. The depth of shelving is much greater than the depth of the studs, rendering the shelves herein much more functional. Even more important, means are provided for supporting one or more stud shelves during installation so that installing them no longer seems like it should be a two person job. In addition the shelves can be simply made, either out of plastic or metal.

SUMMARY OF THE INVENTION

This invention is directed to a shelf adapted to fit horizontally between wall forming studs in areas of buildings where the wall studs are exposed. The shelf is a panel member shaped to form of a front rectangle with a smaller rear rectangle projecting from its rear longer side. The smaller rear rectangle is centered between the sides of the front rectangle so that a right angle recess is formed in the panel on each side of the rear rectangle. Panel edges forming the two recesses are each side of the smaller rear rectangle, and the rear surfaces of the front rectangle which extend beyond the sides of the rear smaller rectangle. The panel member thus has a front edge which is the longer side of the larger front rectangle, a back edge which is the longer side of the of the projecting integral smaller rear rectangle, and two rear recesses. The front edge of the panel is the shelf front, and the back edge of the panel is the shelf back. The shelf has offset sides because of the two rear recesses. The sides of the smaller rear rectangle are so spaced apart that the rectangle fits between adjacent studs with those sides in abutment with those studs, and with the studs in the recesses. The sides of the front panel are so spaced apart that they extend over half of each adjacent stud. This way they abut a side of an adjacent shelf to fore continuous shelving. To hold the shelf in place until it is securely attached to the studs spike means bite into the adjacent studs. The spikes extend rearwardly into the recesses from the rear surfaces of the front rectangle, those which form one edge of each recess. In other words, the spikes project from the rear surfaces of the front rectangle which extend beyond the sides of the rear smaller rectangle. And means are provided for attaching the sides of the rear rectangle of the shelf so supported to abutting adjacent studs.

DESCRIPTION OF THE DRAWINGS

An advantage of the stud shelving which is the subject of this invention is that the shelves are in the form of single panels, provided in their preferred embodiments with flanges formed by bending the edges of the panels. This will be better understood by reference to the accompanying drawings.

DETAILED DESCRIPTION OF THE INVENTION

Figure 1:
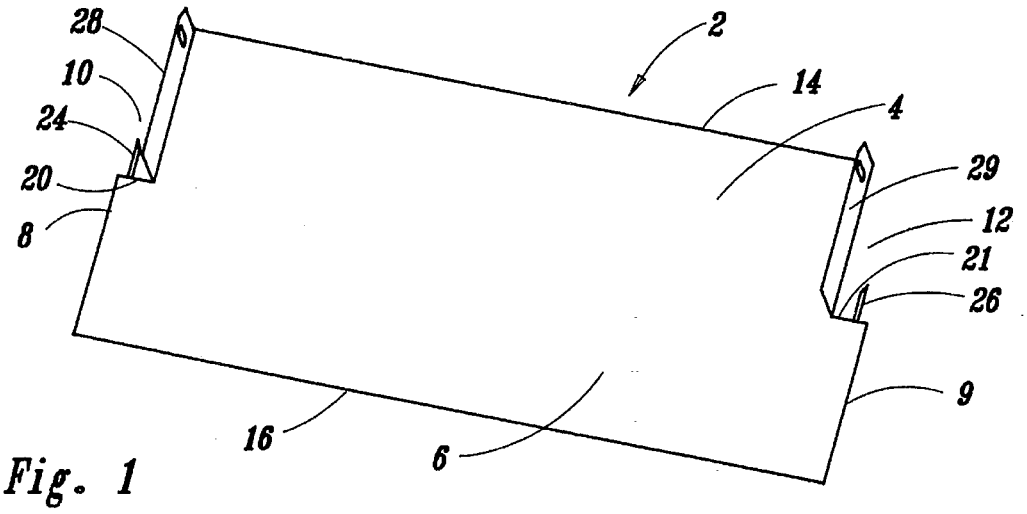
FIG. 1 is a view showing, from the top, the general configuration of the shelving provided herein.

Referring first to FIG. 1, this figure shows an embodiment whose only flanges are upwardly extending surfaces 28 and 29 for attachment to vertical wall studs. FIG. 1 illustrates that the shelf, desirably, is fabricated from a single panel 2 in the shape of two integral rectangles 4 and 6. Rectangle 4, as can be seen, is smaller than rectangle 6. Rectangle 4 is also centered between the sides 8 and 9 of larger rectangle 5. This structure results in recesses or cut-always 10 and 12. In the embodiment shown the recesses are formed by bends forming upwardly extending flanges 28 and 29.

Because of recesses 10 and 12, panel 2 has a short edge 14 and a long edge 16, along with offset sides 8 and 9 of the larger rectangle 6 and sides with flanges 28 and 29, belonging to the smaller panel 4. As a shelf, edge 14 is the rear or back shelf edge, and edge 16 is the shelf front edge. The sides of the shelf, shown at 8 and 9, as well as at 28 and 29, are offset.

Figure 4:
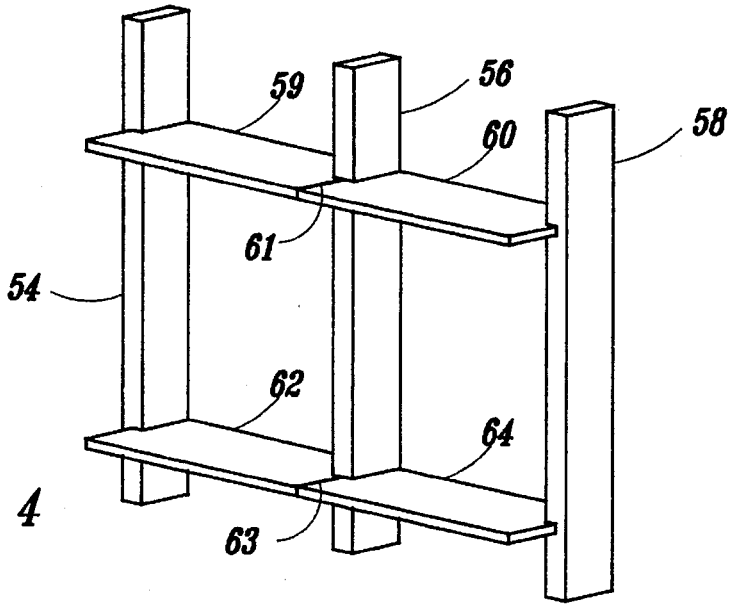
FIG. 4 is a view showing four shelves installed between studs to illustrate continuous shelving.

To visualize how the shelf will fit between two studs in the manner illustrated in FIG. 4 recesses 10 and 12 are to be considered. The width, between sides, i.e. flanges 28 and 29, of the rear or smaller rectangle 4 is equal to the distance between two studs. The smaller rectangle is thus so dimensioned that flanges 28 and 29 rest against the studs they are between. The depth of the smaller rectangle, taken along flanges 28 and 29, is equal to the stud depth, the stud depth being the distance from a wall behind the stud to the front of the stud. This prevents objects from falling off of the back edge of the shelf once it is installed. When panel 2 is so structured the rear edges 20 and 21 of the larger rectangle 6 which extend beyond the sides of rectangle 4 rest against the front surfaces of the studs the rear rectangle is between.

It will be understood that when the shelf (panel 2) is inserted between two studs, those studs occupy recesses 10 and 12 previously described. The front portion of the shelf, that is, larger rectangle 6 projects forwardly beyond the studs to provide additional shelf space not heretofore provided for. An important feature of the invention is that rear edges 20 and 21 of front rectangle 6 are a half a stud width for reasons to be explained. In other words, sides 8 and 9 of front rectangle 6 each extend half way across the stud which is in their recesses 10 and 12.

An even more important feature of this invention is the ease of shelf installation. Stud shelves known to us are unmanageable during installation because it necessary to use both hands to drive nails or screws which hold them. When the first side of the shelf is being attached, the other end of the shelf hangs loosely or wobbly. The stud shelves herein overcome this drawback. They are provided with spike means such as 24 and 26 which hold them in place, freeing both hands for the installation. The shelf is merely pushed between two studs to force the spikes into the studs. The spikes, which project from the rear edges 20 and 21 of larger rectangle 6, are directed into recesses 10 and 12. The shelf is pushed between the two studs until shelf recessed edges 20 and 21 come into abutment with the stud fronts, at the same time forcing spikes 24 and 26 into the studs. The shelf can then readily be attached to the studs, using screws or nails, through flanges 28 and 29.

PREFERRED EMBODIMENT OF THE INVENTION

Figure 2:
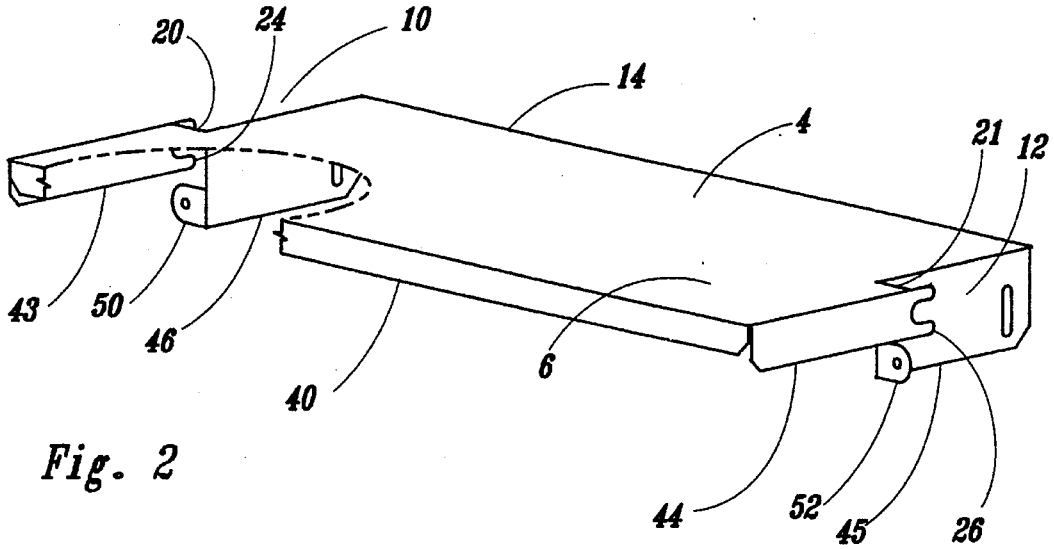
FIG. 2 is an isometric view, partially cut away, illustrating a preferred shelf of the invention.

The shelf depicted in FIG. 1 was a simplified form of stud shelf making it easier to visualize the two integral rectangles and the recesses. Our preferred form of the shelf is shown in FIG. 2. In FIG. 2 larger and smaller rectangles 6 and 4 are shown as well as recesses 10 and 12, bounded by back edges 20 and 21 of larger rectangle 6 and side flanges 45 and 46 of smaller rectangle 4. In this more desirable shelf the edges of both rectangles 4 and 6 are bent downwardly to form a shelf front flange 40, a shelf back flange not visible, and offset shelf side flanges 43, 44, 45, and 46. Thus for added strength and beauty all edges of the shelf include downwardly depending flanges.

For ease of fabrication it will be desirable that spike means be formed or cut in the front side flanges 43 and 44. This construction results in bifurcated prongs 24 and 26 adapted to bite into the studs.

Another feature of the shelf embodiment illustrated in FIG. 2 is the provision of additional shelf stabilizing means. Bights or tabs 50 and 52 are bent portions normal to the side flanges 45 and 46 in order to lie on or rest against the front surfaces of each stud. The bights are provided with holes for attachment to the stud fronts for added shelf rigidity.

It is to be appreciated that by the practice of this invention rigid, versatile and aesthetically desirable stud shelving is provided. As described, since flanges 43 and 44 each extend outwardly from centers of adjacent studs they are in abutment with each other to fore continuous shelving as illustrated in FIG. 4. Thus, studs 54, 56, and 58 support adjacent shelves 59 and 60 whose flanges are in abutment at 61, and shelves 62 and 64 whose flanges are in abutment at 63.

OTHER FORMS OF THE INVENTION

Having been given the teachings of this invention variations and ramifications will occur to those in the field. As an example, instead of turn down flanges as illustrated in FIG. 2, the flanges, especially the front flange can be upwardly directed. In the embodiment in FIG. 3 the shelf front flange 30 is bent upwardly. These flanges are desirable when a series of shelves are used to fore continuous shelving as seen in FIG. 4. The resulting row of upwardly directed flanges will tend to keep items from falling off of the front of such continuous shelving.

Figure 3:
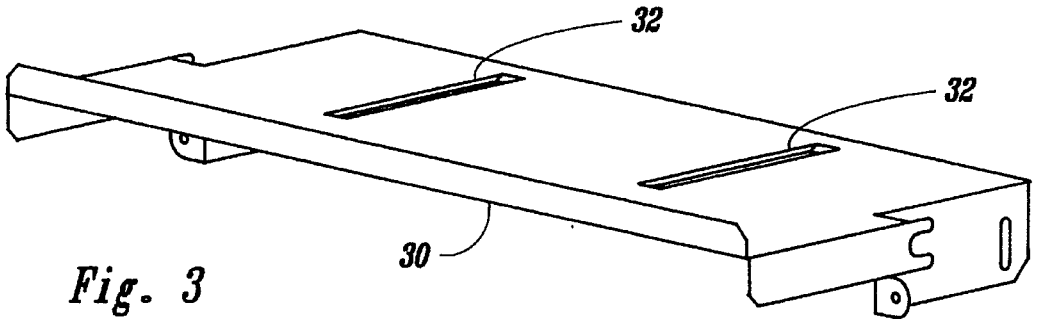
FIG. 3 is an isometric view of a different embodiment of the invention.

Another form of the invention is also depicted in FIG. 3. Frequently it is desirable to be able to hang such items as tools and the like from the underside of a shelf using S-type or other hooks. In FIG. 3 one form of hook hanger is shown. To form the hook hanger two approximately parallel transverse cuts are make in the shelf so that the area between them can be depressed or pushed downwardly. The depressed strip forms a strap serving as a hook hanger rod for scissors, wrenches and similar articles.

Figure 5:
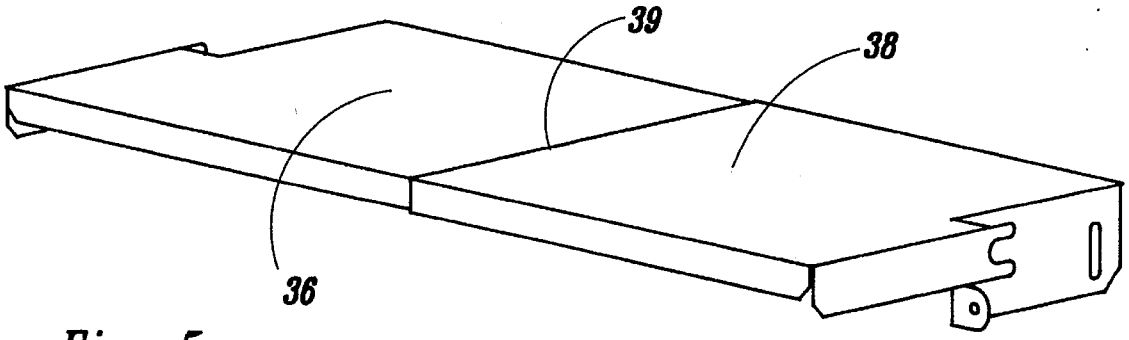
FIG. 5 is an isometric view of still another embodiment of the invention.

Still another variation of the invention is illustrated in FIG. 5. In that figure an adjustable shelf is shown. Builders might possibly become careless, occasionally spacing studs further than the normal distance apart. If continuous shelving is desired and at some point in the installation studs are too far apart for flanges 45 and 46 (FIG. 2) to rest against, shelf installation will have to be discontinued. This is especially undesirable if it happens in the center of a continuous shelf. In such stud structures the adjustable shelf of FIG. 5 can be used. In this shelving, shelf half 36, which is slidable within shelf half 38 at the end 39 of shelf-half 38, telescopes longitudinally into the outer half shelf so that it can be adjusted to any width. The telescoping shelf halves are long enough to provide sufficient overlap to afford the necessary shelf strength.

In addition to these possible alterations, when continuous shelving such as that shown in FIG. 4 is installed, it may be desirable for increased rigidity or strength to bolt the two abutting sides, (43 or 44 of FIG. 2) together at junctures 61 and 63 shown in FIG. 4. As another variation, when FIGS. 2 and 4 are compared it can be seen that the larger rectangle 6 is the shelf surface which extends beyond the studs. The width of rectangle 6 is determined by the distance between studs. The depth of rectangle 6, however, determines the size of the shelf. Hence, the larger the desired shelf space, the greater should be the depth of rectangle 6. These and other variations, then, will occur to those in the art. Such modifications are deemed to be within the scope of this invention.

What is claimed is:

1. A shelf adapted when installed to fit horizontally between two wall forming studs in areas of buildings where the studs are exposed, the shelf being a panel member shaped in the form of a front rectangle with a smaller rear rectangle projecting from its rear longer side, the smaller rear rectangle being centered between the sides of the front rectangle so that a right angle recess is formed in the panel member on each side of the rear rectangle, edges of each right angle recess being the sides of the rear rectangle and adjoining rear surfaces of the front rectangle, which rear surfaces extend beyond the rear rectangle sides, the panel member thus having a front edge formed by the longer side of the larger front rectangle, a back edge formed by the longer side of the smaller rear rectangle, the front edge being the shelf front, the back edge being the shelf back, and sides of the shelf being offset shelf sides due to the fight angle recesses, the width between the sides of the rear rectangle being equal to the distance between two studs so that when installed the rectangle fits between two adjacent studs with a side in abutment with each stud and with the studs in the right angle recesses, the distance between the sides of the front rectangle being such that when installed each side extends half way across an adjacent stud in order to abut a side of an adjacent shelf when installed to form continuous shelving, spike means in the rear surfaces of the front rectangle, the surfaces which extend beyond the rear rectangle sides, said spike means projecting into the right angle recesses to bite into the adjacent studs to hold the shelf in place until it is securely attached to the adjacent studs, and means for attaching to the adjacent studs, sides of the rear rectangle of the shelf so supported.

2. The stud shelf of claim 1 having panel halves telescoping longitundinally with one slidable within the other panel half for width adjustability.

3. The stud shelf of claim 1 wherein the front edge of the larger rectangle is bent upwardly to form an upwardly directed shelf front flange.

4. The stud shelf of claim 1 wherein the front, back, and sides shelf edges are each provided with downwardly directed flanges.

5. The stud shelf of claim 4 wherein the front, back and side flanges are each downwardly bent panel edges.

6. The stud shelf of claim 5 where the front ends of each side flange of the rear smaller rectangle are bent outwardly to form bights adapted to lie against the stud fronts.

7. The stud shelf of claim 6 wherein a hanging strap depends from the underside of the shelf to serve as a hook hanger.

* * * * *